US007432826B2

(12) United States Patent
Schwartz

(10) Patent No.: US 7,432,826 B2
(45) Date of Patent: Oct. 7, 2008

(54) TRAFFIC PREEMPTION SYSTEM WITH HEADWAY MANAGEMENT

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 308 days.

(21) Appl. No.: 11/154,347

(22) Filed: Jun. 16, 2005

(65) Prior Publication Data

US 2007/0008173 A1 Jan. 11, 2007

(51) Int. Cl.
*G08G 1/00* (2006.01)

(52) U.S. Cl. ..... 340/902; 340/902; 340/906; 701/117

(58) Field of Classification Search ..... 340/902, 340/907, 901, 916, 906; 701/117
See application file for complete search history.

(56) References Cited

U.S. PATENT DOCUMENTS

| | | | | |
|---|---|---|---|---|
| 3,550,078 | A | 12/1970 | Long | 340/32 |
| 3,831,039 | A | 8/1974 | Henschel | 307/234 |
| 4,162,447 | A | 7/1979 | Teshirogi et al. | 325/18 |
| 4,162,477 | A | 7/1979 | Munkberg | 340/32 |
| 4,228,419 | A | 10/1980 | Anderson | 340/32 |
| 4,230,992 | A | 10/1980 | Munkberg | 328/140 |
| 4,234,967 | A | 11/1980 | Henschel | 455/603 |
| 4,463,339 | A | 7/1984 | Frick et al. | 340/906 |
| 4,680,811 | A | 7/1987 | Harper et al. | 455/617 |
| 4,704,610 | A | 11/1987 | Smith et al. | 340/906 |
| 4,717,913 | A | 1/1988 | Elger | 340/825.54 |
| 4,727,600 | A | 2/1988 | Avakian | 455/601 |
| 4,734,881 | A | 3/1988 | Klein et al. | 364/900 |
| 4,914,434 | A | 4/1990 | Morgan et al. | 340/906 |
| 4,970,439 | A | 11/1990 | Stopa | 315/241 R |
| 4,972,185 | A | 11/1990 | Stopa et al. | 340/825.72 |
| 4,992,790 | A | 2/1991 | Montgomery | 341/70 |
| 5,014,052 | A | 5/1991 | Obeck | 340/906 |

(Continued)

FOREIGN PATENT DOCUMENTS

WO WO-2006138364 A2 12/2006

OTHER PUBLICATIONS

"Strobecom II, Optical Preemption and Priority Control System", http://www.tomar.com/strobecom/index.htm, 3, pages. Printed from Internet Feb. 8, 2005.

(Continued)

*Primary Examiner*—Phung Nguyen
(74) *Attorney, Agent, or Firm*—Schwegman, Lundberg & Woessner, P.A.

(57) ABSTRACT

A traffic-preemption system and method that communicates an identification code from vehicles to a traffic location. Traffic light control equipment, such as a receiver and traffic light circuit at each intersection of a controlled area, is used to manage headway in mass-transit systems as well as to provide traffic light pre-emption for emergency vehicles. Each traffic light circuit in the controlled area has a receiver located at a traffic location and adapted to receive an identification code from a mass-transit vehicle. A decoding circuit responds to the received identification code by attempting to identify the mass-transit vehicle and determine the timing on the identified route that improves an identified vehicle's headway and/or route timing. In response to determining the timing, a traffic-preemption command is generated for a traffic light on the identified route.

20 Claims, 4 Drawing Sheets

U.S. PATENT DOCUMENTS

| | | | | |
|---|---|---|---|---|
| 5,159,480 | A | 10/1992 | Gordon et al. | 359/181 |
| 5,172,113 | A | 12/1992 | Hamer | 340/907 |
| 5,187,373 | A | 2/1993 | Gregori | 340/551 |
| 5,187,476 | A | 2/1993 | Hamer | 340/906 |
| 5,202,683 | A | 4/1993 | Hamer et al. | 340/906 |
| 5,519,389 | A | 5/1996 | DeGunther et al. | 340/870.29 |
| 5,539,398 | A | 7/1996 | Hall et al. | 340/907 |
| 5,602,739 | A | 2/1997 | Haagenstad et al. | 364/436 |
| 5,926,113 | A | 7/1999 | Jones et al. | 340/906 |
| 5,986,575 | A | 11/1999 | Jones et al. | 340/906 |
| 6,064,319 | A | 5/2000 | Matta | |
| 6,243,026 | B1 | 6/2001 | Jones et al. | 340/906 |
| 6,281,808 | B1 | 8/2001 | Glier et al. | 340/933 |
| 6,326,903 | B1 | 12/2001 | Gross et al. | |
| 6,429,812 | B1 | 8/2002 | Hoffberg | 342/357.1 |
| 6,621,420 | B1 | 9/2003 | Poursartip | 340/907 |
| 6,940,422 | B1 | 9/2005 | Bachelder et al. | |
| 6,985,090 | B2 | 1/2006 | Ebner et al. | |
| 7,116,245 | B1 * | 10/2006 | Bachelder | 340/906 |
| 7,202,776 | B2 | 4/2007 | Breed | |
| 7,248,149 | B2 | 7/2007 | Bachelder et al. | |
| 2003/0016143 | A1 * | 1/2003 | Ghazarian | 340/901 |
| 2005/0104745 | A1 * | 5/2005 | Bachelder et al. | 340/906 |
| 2007/0008174 | A1 | 1/2007 | Schwartz | |

OTHER PUBLICATIONS

Tomar Electronics, "Strobecom II", System Manual (Rev 3), Jun. 2000, 25 pages. Jun. 2000.

Tomar Electronics, "Strobecom II. Optical Signal Processor Configuration Software (OSPsoft)," User's Manual, Version 2.0 for use with OSP Version 2.0, May 2000, 40 pages. May 2000.

"Elock™ Emitter Authenticator," http://www.tomar.com/products/elock/elock.htm, 11 pages. Printed from Internet Apr. 27, 2005.

International Search Report for PCT/US06/23148.

"U.S. Appl. No. 11/154,348 response to Non-Final office Action received Aug. 22, 2007.", 9 pgs.

"Non-Final Office Action mailed Aug. 22, 2007 in U.S. Appl. No. 11/154,348", OARN,6 pgs.

"PCT Application No. PCT/US06/23190 International Search Report mailed Oct. 12, 2007", 2 pgs.

"PCT Application No. PCT/US06/23190 Written Opinion mailed Oct. 12, 2007", 4 pgs.

"PCT Application No. PCT/US06/23148, International Search Report mailed May 2, 2007", 3 pgs.

"PCT Application No. PCT/US06/23148, Written Opinion mailed May 2, 2007", 4 pgs.

* cited by examiner

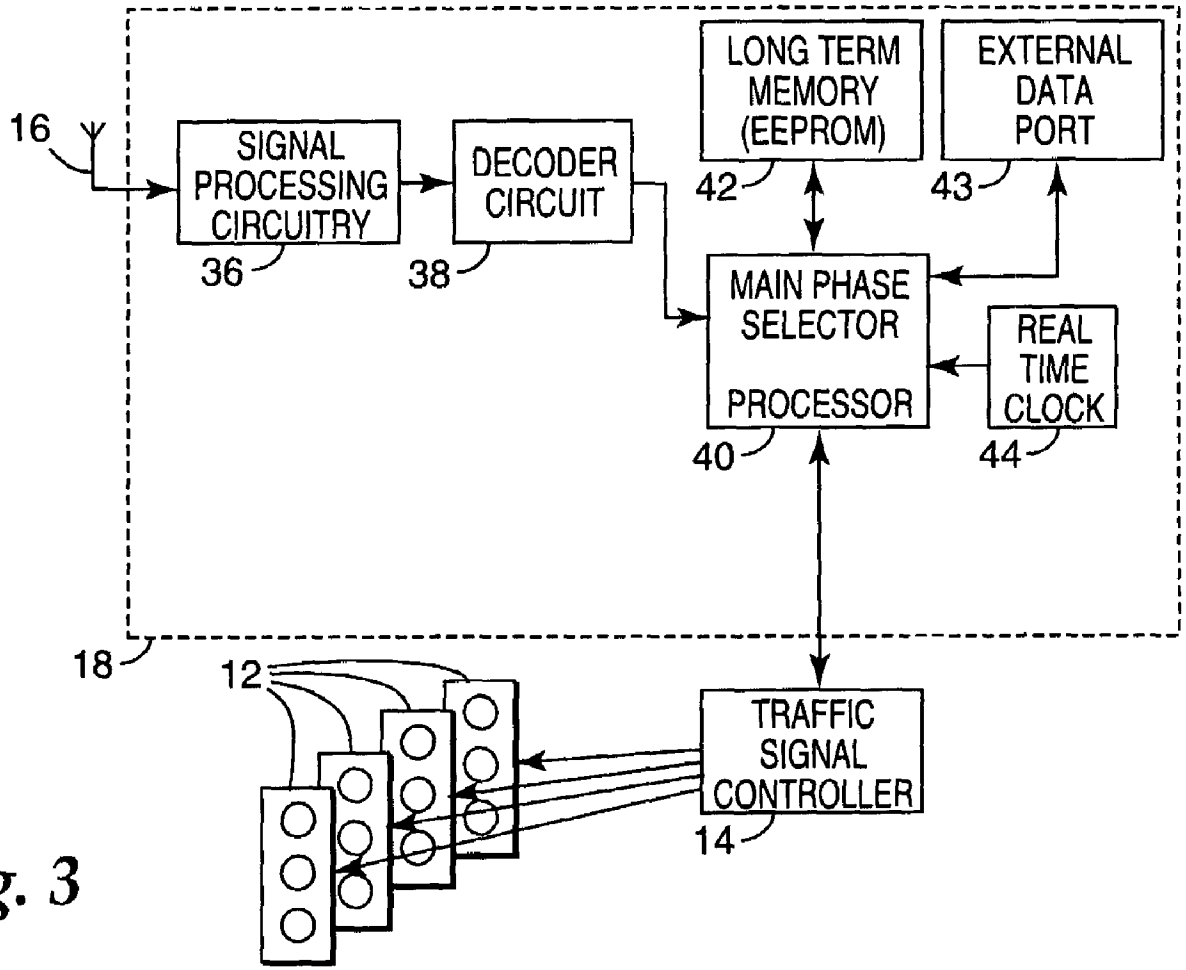
Fig. 3
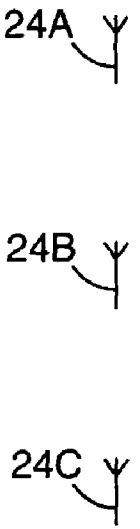

TRAFFIC PREEMPTION SYSTEM WITH HEADWAY MANAGEMENT

FIELD OF THE INVENTION

The present invention is generally directed to systems and methods that allow traffic light systems to be remotely controlled using transmission from a transmitter to a receiver that is communicatively-coupled to a traffic light controller at an intersection.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed. This situation is commonly exemplified in an emergency-vehicle application.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Municipalities that use traffic preemption systems generally also have mass-transit capabilities as well, such as bus systems, trolley cars, or other people moving capabilities. Mass-transit systems present their own problems in the areas of traffic control and scheduling of large numbers of transit vehicles. As traffic and congestion increases, it becomes more difficult to maintain schedules for mass-transit vehicles that share resources with the public, such as roadways. As the population expands, these abovementioned issues may increase.

SUMMARY

The present invention is directed to overcoming the abovementioned challenges and others that are related to the types of approaches and implementations discussed above and in other applications. The present invention is exemplified in a number of implementations and applications, some of which are summarized below.

In connection with one embodiment, the present invention is directed to implementations that allow traffic light systems to be remotely controlled. One such implementation employs data being transmitted to traffic light control equipment located at each intersection in a controlled region. The traffic light control equipment is used to manage headway in mass-transit systems as well as to provide traffic light pre-emption for emergency vehicles.

In a more particular example embodiment, traffic light control equipment, such as a traffic light circuit at each intersection of a controlled area, is used to manage headway in mass-transit systems as well as to provide traffic light pre-emption for emergency vehicles. Each traffic light circuit in the controlled area has a respective receiver located at a traffic location and adapted to receive an identification code transmitted from a mass-transit vehicle. A decoding circuit is adapted to respond to the received identification code by attempting to identify the mass-transit vehicle and determine the timing on the identified route that improves an identified vehicle's headway and/or route timing. In response to determining the timing, a traffic-preemption command can be generated for a traffic light on the identified route.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which:

FIG. 3 is a block diagram of the components of the traffic preemption system shown in FIGS. 1 and 2.

Figure 1:
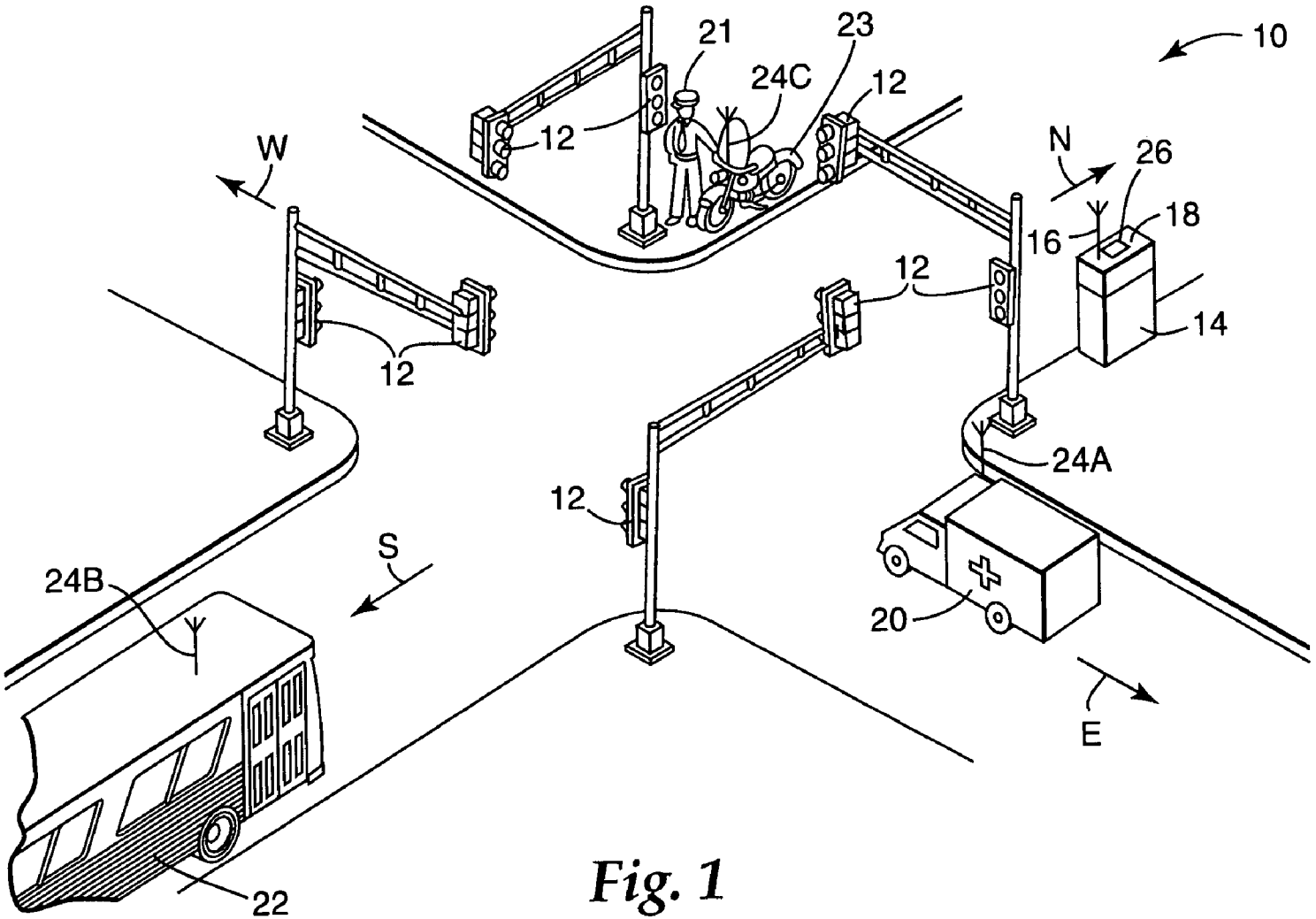
FIG. 1 is a perspective view of a bus and an ambulance approaching a traffic intersection, with antennas mounted to the bus and the ambulance, and each transmitting an identification code in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF THE EMBODIMENTS

The present invention is believed to be applicable to a variety of different types of headway management in a traffic preemption system. While the present invention is not necessarily limited to such approaches, various aspects of the invention may be appreciated through a discussion of various examples using these and other contexts.

A particular embodiment of the present invention is directed to a method of controlling the passage of vehicles, such as busses, through a corridor to maintain a predetermined interval between each vehicle and/or to maintain a predetermined route timing, herein designated as headway management, using a traffic priority system. Traffic priority systems assist authorized vehicles (police, fire and other public safety or transit vehicles) through signalized intersections by making a priority request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. A priority system in accordance with the present invention can also be used by transit vehicles to maintain headway.

In another particular embodiment, the time and location of a mass-transit vehicle is compared with a predetermined schedule. If the mass-transit vehicle is behind schedule, the priority equipment is activated to request green lights to assist the mass-transit vehicle in returning to its predetermined schedule. There are however situations where there is no predetermined schedule but it is desired the have the mass-transit vehicles pass a particular point at regular intervals, for example every 10 minutes. This can be accomplished by recording the time that each vehicle passes through the intersection, and transmitting data to the following vehicle to wait if it is early, or provide it a green light if it is late.

Previous implementations of headway management utilize vehicle detectors and roadside indicators to inform the bus driver of the time since the last vehicle passed through the intersection. In this method there is typically no way to tell the driver what the magnitude of the deviation is. Additionally there is no method to assist the driver to return to the desired interval. Devices and methods in accordance with particular embodiments of the present invention method utilize two-way communications between the intersection and the vehicle to provide an in-cab indication of the interval status in minutes and seconds. Particular embodiments of the present invention may also incorporate a vehicle priority system to help the vehicle return to the standard interval if it has begun to deviate.

One example is the situation of a bus corridor where it is desired to have a bus pass each stop every 10 minutes. Each bus transmits its ID to every intersection it passes. The intersection equipment adds a time tag to the vehicle ID and stores the data. Additionally, as a bus approaches the intersection the time tag of the previous vehicle is compared to the present time and the deviation from the desired interval is computed. The deviation is sent to the approaching vehicle for display to the driver. If the interval exceeds the desired interval a request is made for a green light to help the bus return to the desired interval. It will be appreciated that the bus can compute the deviation from the time tag of the previous vehicle that is provided to the bus from the intersection.

The traffic preemption system shown in FIG. 1 is presented at a general level to show the basic circuitry used to implement example embodiments of the present invention. In this context, FIG. 1 illustrates a typical intersection 10 having traffic lights 12. A traffic signal controller 14 sequences the traffic lights 12 through a sequence of phases that allow traffic to proceed alternately through the intersection 10. The intersection 10 is equipped with a traffic preemption system having certain aspects and features enabled in accordance with the present invention to provide headway management in an efficient, flexible and practicable manner.

Secure communication can be provided in the traffic preemption system of FIG. 1 by way of antennas 24A and 24B for a transmitter or a transceiver, antenna 16 for a receiver or a transceiver, and a phase selector 18. The antenna 16 is stationed to receive an identification code transmitted from authorized vehicles approaching the intersection 10. The receiver for antenna 16 communicates with the phase selector 18, which is typically located in the same cabinet as the traffic controller 14, and which differentiates between authorized vehicles and unauthorized vehicles using a high-integrity, approach, such as by using data encryption. Data encryption approaches are further described in commonly assigned co-pending patent application Ser. No. 11/154,348 filed Jun. 16, 2005, which is hereby incorporated herein by reference.

In FIG. 1, an ambulance 20 and a bus 22 are approaching the intersection 10. The antenna 24A is mounted on the ambulance 20 and the antenna 24B is mounted on the bus 22. The antennas 24A and 24B each transmit a radio frequency signal. It will be appreciated that a vehicle identification code can be transmitted from a vehicle 20 or 22 using a stream of light pulses in another embodiment. The radio frequency signal can transport codes that identify a requested command or operation in addition to the identification code. The antenna 16 receives this radio frequency signal and sends an output signal to the phase selector 18. The phase selector 18 processes and validates the output signal from the antenna 16. For certain validated output signals, the phase selector 18 issues a traffic preemption command to the traffic signal controller 14 to preempt the normal operation of the traffic lights 12.

FIG. 1 also shows an authorized person 21 operating a portable transmitter or receiver with antenna 24C, which is there shown mounted to a motorcycle 23. In one embodiment, configuration of a phase selector 18, including setting any headway management information 26 including mass-transit vehicle schedules, is manually perform by authorized maintenance personnel 21. In another embodiment, the antenna 24C is used by the authorized person 21 to affect the traffic lights 12 in situations that require manual control of the intersection 10.

In accordance with embodiments of the present invention, if the bus 22 and the ambulance 20 are both approaching the intersection 10, and both requesting pre-emption of the traffic signal controller 14, a hierarchy may be provided to the traffic signal controller 14 to determine which vehicle is awarded pre-emption. In this particular example, the ambulance 20 may have a predetermined hierarchy higher than the bus 22, such that the ambulance 20 pre-emption request is always honored before the request by the bus 22. In other situations, such as two busses approaching the intersection 10 from perpendicular directions, the bus having the longest delay relative to its schedule may be awarded pre-emption over the bus that is closest to on-time.

Figure 2:
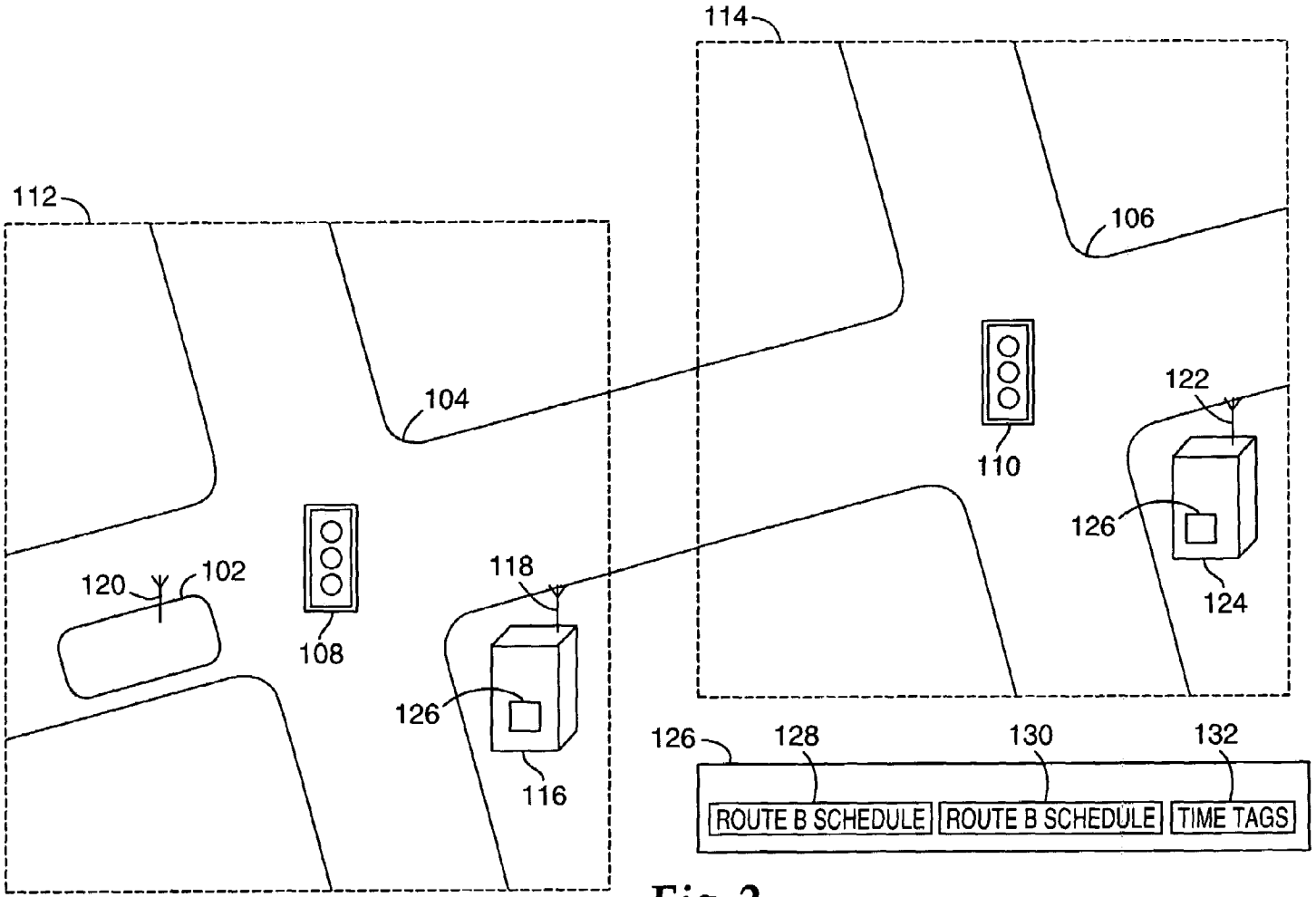
FIG. 2 is a view of a mass-transit vehicle approaching and controlling multiple traffic intersections using preemption of the traffic lights in accordance with the present invention.

FIG. 2 is a view of a mass-transit vehicle 102 approaching and controlling multiple traffic intersections 104 and 106 on its route in accordance with the present invention. Intersection 104 is in controlled region 112, such as on a city transit route, and intersection 106 is in controlled region 114, which may, for example, be on the transit route of the mass-transit vehicle 102 as well as in the control region of other mass-transit vehicles traveling on other routes. A governmental body for controlled region 112, such as a city government, can install a traffic light control system for traffic light 108 permitting preemption of the normal operation of the traffic light 108 to expedite passage through the intersection 104 by an emergency vehicle at a highest priority, and allow pre-emption by the mass-transit vehicle 102 at a lower priority, to maintain headway.

Intersection 104 has a traffic light controller 116 that controls the operation of traffic lights 108 and supports preemption of the normal operation of the traffic lights 108. Typically, the traffic light control system for intersection 104 includes an antenna 118 that receives data from an antenna 120 of mass-transit vehicle 102. Typically, antenna 120 is mounted on the roof of the mass-transit vehicle 102 and can be directionally orientated to preferentially emit a radio-frequency signal in the direction of travel by the mass-transit vehicle 102. Signals from the antenna 118 for a requested preemption of the traffic light 108 by mass-transit vehicle 102 are coupled to the traffic light controller 116. In response to the requested preemption, the traffic light controller 116 adjusts the phase of the traffic lights 108 to permit passage of the mass-transit vehicle 102 through the intersection 104. Intersection 106 may similarly have antenna 122 and controller 124 for traffic light 110.

Each traffic light controller may include a respective copy of headway management information 126. Headway management information 126 can include schedule information for each bus route passing through the intersection, for example route-B schedule 128 and route-A schedule 130, and time tags 132 for each route for the busses previously passing through the intersection. Schedules 128 and 130 can include a scheduled time of arrival at the corresponding intersection for each bus on each route and/or a desired spacing interval between busses at various times of the day, week, or year.

In one embodiment, time tags 132 are updated upon recognizing the ID of a mass-transit vehicle 102 transmitted from antenna 120. In another embodiment, timing information, such as the relative time of the mass-transit vehicle 102 on its route, may be transmitted to the traffic light controller 116 by the mass-transit vehicle 102, or may be communicated using a network, such as an Internet connection, connecting the traffic light controller 116 and the traffic light controller 124. Further, information may be sent to the mass-transit vehicle 102 from the traffic light controller 116 via antenna 118 and 120, or the mass-transit vehicle 102 may be communicatively coupled to a central facility and/or management system using cellular technology or other communications mechanism.

In another embodiment of the present invention, a traffic preemption system helps run a mass transit system more efficiently. An authorized mass transit vehicle constructed in accordance with the present invention, such as the bus 22 in FIG. 1, spends less time waiting at traffic signals, thereby saving fuel and allowing the mass transit vehicle to serve a larger route. This also encourages people to utilize mass transportation instead of private automobiles because authorized mass transit vehicles move through congested urban areas faster than other vehicles.

Referring back to FIG. 1, unlike an emergency vehicle 20, a mass transit vehicle 22 may not require total preemption. In one embodiment, a traffic signal offset is used to give preference to a mass transit vehicle 22, while still allowing all approaches to the intersection to be serviced. For example, a traffic signal controller that normally allows traffic to flow 50 percent of the time in each direction responds to repeated phase requests from the phase selector to allow traffic flowing in the direction of the mass transit vehicle 22 to proceed 65 percent of the time and traffic flowing in the other direction to flow 35 percent of the time. In this embodiment, the actual offset can be fixed to allow the mass transit vehicle 22 to have a predictable advantage. Generally, proper authorization should be validated before executing an offset for a mass transit vehicle 22.

In an example installation, the traffic preemption system does not actually control the lights at a traffic intersection. Rather, the phase selector 18 alternately issues phase requests to and withdraws phase requests from the traffic signal controller, and the traffic signal controller 14 determines whether the phase requests can be granted. The traffic signal controller 14 may also receive phase requests originating from other sources, such as a nearby railroad crossing, in which case the traffic signal controller 14 may determine that the phase request from the other source be granted before the phase request from the phase selector. However, as a practical matter, the preemption system can affect a traffic intersection 10 and create a traffic signal offset by monitoring the traffic signal controller sequence and repeatedly issuing phase requests that will most likely be granted.

According to a specific example embodiment, the traffic preemption system of FIG. 1 is implemented using a known implementation that is modified to implement the codes and algorithms discussed above for traffic prioritization and integrated headway management. For example, an OPTICOM Priority Control System can be modified to implement the codes and algorithms discussed above for traffic prioritization and integrated headway management (OPTICOM is a trademark name for a traffic preemption system manufactured by 3M Company of Saint Paul, Minn.) Consistent with features of the OPTICOM Priority Control System, one or more embodiments of U.S. Pat. No. 5,172,113, No. 5,539,398, and No. 5,602,739 hereby incorporated herein by reference, can be modified in this manner. Also according to the present invention, another specific example embodiment is implemented using another so-modified commercially-available traffic preemption system, such as the Strobecom II system (manufactured by TOMAR Electronics, Inc. of Phoenix, Ariz.).

FIG. 3 is a block diagram showing the traffic preemption system of FIG. 1. In FIG. 3, radio frequency signals originating from the antennas 24A, 24B and 24C are received by the antenna 16, which is connected to the phase selector 18. The phase selector 18 may include receiver signal processing circuitry 36 and a decoder circuit 38, a main phase selector processor 40, long-term memory 42, an external data port 43 and a real time clock 44. The main phase selector processor 40 communicates with the traffic signal controller 14, which in turn controls the traffic lights 12.

The signal processing circuitry 36 receives an analog signal provided by the antenna 16. The signal processing circuitry 36 processes the analog signal and produces a digital signal that is received by the decoder circuit 38. The decoder circuit 38 extracts data from the digital signal, validates proper authorization and provides the data to the main phase selector processor 40.

The long-term memory 42 is implemented using electronically erasable programmable read only memory (EEPROM). The long-term memory 42 is coupled to the main phase selector processor 40 and is used to store a list of authorized identification codes and to log data. In addition, headway information 45, such as schedule and time tags for mass-transit vehicles, can be stored in long-term memory 42.

The external data port 43 is used for coupling the phase selector 18 to a computer. In one embodiment, external data port 43 is an RS232 serial port. Typically, portable computers are used in the field for exchanging data with and configuring a phase selector. Logged data is removed from the phase selector 18 via the external data port 43, and headway information 45 and a list of authorized identification codes is stored in the phase selector 18 via the external data port 43. The external data port 43 can also be accessed remotely using a wired or wireless modem, local-area network or other such device.

The real time clock 44 provides the main phase selector processor 40 with the actual time. The real time clock 44 provides time stamps that can be logged to the long-term memory 42 and is used for timing events, including timed passing of vehicles, such as mass-transit vehicles. In one embodiment, real time clock 44 is used to check the relative arrival time of a mass-transit vehicle to its associated schedule, to determine if traffic light preemption is desirable.

Figure 4:
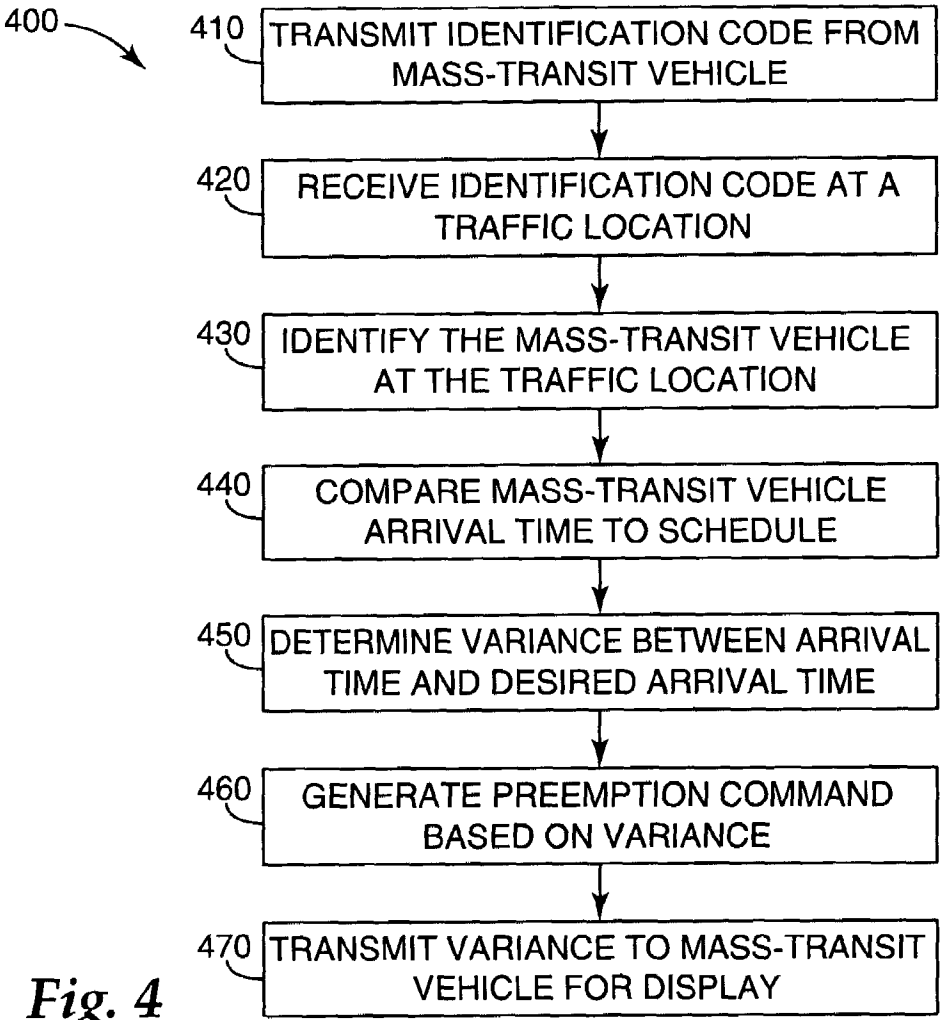
FIG. 4 is a flow diagram of the operation of the traffic preemption system at a vehicle and an intersection in accordance with the present invention.

FIG. 4 is a flow diagram of the operation of the traffic preemption system at a vehicle and an intersection in accordance with the present invention. In FIG. 4, a method 400 involves transmitting data 410 from a transmitter or transceiver associated with a mass-transit vehicle. The data may include an identification code for the mass-transit vehicle and/or route information and/or timing information. The data is received 420 at receiver or transceiver situated at the traffic location. The mass-transit vehicle is identified 430 using the identification code, such as by identifying the route, the vehicle identification, the vehicles scheduled arrival time, and/or other identifying information. A time of the mass-transit vehicle's arrival at the traffic location is compared 440 with a pre-determined schedule, such as by comparing the time information provided in the identification with the actual time, comparing the arrival time to a known schedule, or other comparison. A variance is determined 450 between the time of arrival and the desired arrival time from the pre-determined schedule, and a traffic-preemption command is generated 460 for a traffic light based on the determined variance. For example, if it is determined that the vehicle is behind schedule more than a predetermined length of time, the preemption command may be generated to shorten a wait at a stop-light. In another embodiment, if the previous mass-transit vehicle on the same route is within a pre-determined length of time, the traffic signal may provide an indicator suggesting the mass-transit vehicle should, for example, temporarily remain stationary at a bus stop in front of the traffic signal in order to separate the mass-transit vehicles, thereby maintaining headway. The variance can optionally be transmitted 470 to the mass-transit vehicle for display to an operator of the vehicle. The operator may adjust the travel of the mass-transit vehicle based on the displayed variance. For example, the operator may stop at the next bus stop for an additional amount of time that reduces the displayed variance to an acceptable level.

While certain aspects of the present invention have been described with reference to several particular example embodiments, those skilled in the art will recognize that many changes may be made thereto. For example, the identification code transmitter and detector circuitry, as well as the data signal processing (data look-up, data sending and formatting, preemption hierarchy, and data en/decryption) can be implemented using a signal processing circuit arrangement including one or more processors, volatile and/or nonvolatile memory, and a combination of one or more analogy, digital, discrete, programmable-logic, semi-programmable logic, non-programmable logic circuits. Examples of such circuits for comparable signal processing tasks are described in the previously-discussed commercial devices and various references including, for example, U.S. Pat. Nos. 5,172,113; 5,519,389; 5,539,398; and 4,162,447. Such implementations and adaptations are embraced by the above-discussed embodiments without departing from the spirit and scope of the present invention, aspects of which are set forth in the following claims.

What is claimed is:

1. A traffic-preemption system, comprising:

a transmitter adapted to transmit an identification code of a mass-transit vehicle; and a traffic light circuit having receiver located at a traffic location and adapted to receive the identification code, and a decoding circuit adapted to attempt to identify the mass-transit vehicle using the identification code, compare a time of the mass-transit vehicle's arrival at the traffic location with a pre-determined schedule, and, in response to determining a variance between the time of arrival and the pre-determined schedule, generate a traffic-preemption command for a traffic light.

2. The traffic-preemption system of claim 1, wherein the decoding circuit is further adapted to generate the traffic-preemption command for a traffic light at the traffic location.

3. The traffic-preemption system of claim 1, wherein the decoding circuit is further adapted to generate the traffic-preemption command for a traffic light at a traffic location further along the mass-transit vehicle's route.

4. The traffic-preemption system of claim 1, wherein the decoding circuit is further adapted to generate the traffic-preemption command for a traffic light based on a preemption hierarchy.

5. The traffic-preemption system of claim 1, wherein the receiver is further adapted to receive an identification code from a second mass-transit vehicle; and the decoding circuit is further adapted to attempt to identify the second mass-transit vehicle, compare a time of the second mass-transit vehicle's arrival at the traffic location with a pre-determined schedule, and, in response to determining a variance between the time of arrival and the pre-determined schedule for both mass-transit vehicles, generate a traffic-preemption command for a traffic light based on the mass-transit vehicle having the largest variance.

6. The traffic-preemption system of claim 1, wherein the mass-transit vehicle further comprises a receiver configured to facilitate two-way communications between the mass-transit vehicle and the traffic light circuit, whereby variance information may be communicated to the mass-transit vehicle.

7. A method for managing headway of a mass-transit vehicle at a traffic location in a traffic-preemption system, comprising:

transmitting an identification code from a transmitter associated with the mass-transit vehicle;

receiving the identification code at a receiver situated at the traffic location;

identifying the mass-transit vehicle using the identification code;

comparing a time of the mass-transit vehicle's arrival at the traffic location with a predetermined schedule;

determining a variance between the time of arrival and the pre-determined schedule; and generating a traffic-preemption command for a traffic light based on the determined variance.

8. The method of claim 7, further comprising generating the traffic-preemption command for the traffic light in response to the determined variance exceeding a threshold.

9. The method of claim 7, wherein the traffic-preemption command is generated for the traffic light at the traffic location.

10. The method of claim 7, wherein the traffic-preemption command is generated for the traffic light at a traffic location further along the mass-transit vehicle's route.

11. The method of claim 7, wherein the traffic-preemption command is generated based on a preemption hierarchy.

12. The method of claim 7, wherein the traffic-preemption command is generated to facilitate regular intervals between the mass-transit vehicle and other mass-transit vehicles.

13. The method of claim 7, wherein the traffic-preemption command is generated to facilitate schedule adherence by the mass-transit vehicle.

14. A traffic-preemption system, comprising:

a first transceiver associated with a mass-transit vehicle and adapted to transmit an identification code of the mass-transit vehicle and receive encoded information; and a controller provided at each one of a plurality of intersections;

a respective second transceiver coupled to each controller and adapted to receive the transmitted identification code from the first transceiver and to transmit the encoded information to the first transceiver; and a respective decoding circuit coupled to each controller and adapted to attempt to identify the mass-transit vehicle using the identification code;

wherein the controller is adapted to compare a time of the mass-transit vehicle's arrival at the one of the intersections with a pre-determined schedule, and, in response to determining a variance between the time of arrival and the pre-determined schedule, generate a traffic-preemption command for a traffic light and transmit variance information to the mass-transit vehicle.

15. The traffic-preemption system of claim 14, wherein the controller is further adapted to generate the traffic-preemption command for a traffic light at the mass-transit vehicle's present intersection.

16. The traffic-preemption system of claim 14, wherein the controller is further adapted to generate the traffic-preemption command for a traffic light at an intersection further along the mass-transit vehicle's route.

17. The traffic-preemption system of claim 14, wherein the controller is further adapted to generate the traffic-preemption command for a traffic light based on a preemption hierarchy.

18. A traffic-preemption system, comprising:

means for transmitting an identification code from a transmitter associated with the mass-transit vehicle;

means, for receiving the identification code at a receiver situated at the traffic location;

means for identifying the mass-transit vehicle using the identification code;

means for comparing a time of the mass-transit vehicle's arrival at the traffic location with a pre-determined schedule;

means for determining a variance between the time of arrival and the pre-determined schedule; and means for generating a traffic-preemption command for a traffic light based on the determined variance.

19. The traffic-preemption system of claim 18, wherein the generating means comprises means for determining if the variance exceeds a threshold.

20. The traffic-preemption system of claim 19, wherein the generating means comprises means for determining a traffic-preemption command hierarchy.

* * * * *